US008015848B2

(12) United States Patent
Colon et al.

(10) Patent No.: US 8,015,848 B2
(45) Date of Patent: Sep. 13, 2011

(54) ACOUSTIC PANEL

(75) Inventors: Mario Ascander Colon, Raleigh, NC (US); Jason Duckworth, Kinston, NC (US); Gregory Van Vooren, Greenville, NC (US)

(73) Assignee: Electrolux Home Products, Inc., Cleveland, OH (US)

( * ) Notice: Subject to any disclaimer, the term of this patent is extended or adjusted under 35 U.S.C. 154(b) by 218 days.

(21) Appl. No.: 12/357,942

(22) Filed: Jan. 22, 2009

(65) Prior Publication Data

US 2010/0180916 A1 Jul. 22, 2010

(51) Int. Cl.
*D06F 37/26* (2006.01)

(52) U.S. Cl. ..... 68/3 R

(58) Field of Classification Search ..... 134/201; 68/3 R; 181/284, 286, 293
See application file for complete search history.

(56) References Cited

U.S. PATENT DOCUMENTS

| | | | | | |
|---|---|---|---|---|---|
| 1,554,179 | A | * | 9/1925 | Trader | 181/293 |
| 2,173,797 | A | * | 9/1939 | Toohey et al. | 181/208 |
| 2,280,631 | A | * | 4/1942 | Coffey | 181/293 |
| 2,320,737 | A | * | 6/1943 | Hutten | 181/293 |
| 2,556,884 | A | | 6/1951 | Muller | |
| 2,958,911 | A | * | 11/1960 | Given et al. | 52/792.1 |
| 3,295,541 | A | * | 1/1967 | Ummel | 134/182 |
| 3,529,881 | A | * | 9/1970 | Kaldenberg | 312/276 |
| 4,094,379 | A | * | 6/1978 | Steinberger | 181/284 |
| 4,273,213 | A | * | 6/1981 | Munz | 181/207 |
| 4,420,526 | A | * | 12/1983 | Schilling et al. | 428/171 |
| 4,461,796 | A | | 7/1984 | Fukahori et al. | |
| 4,909,003 | A | * | 3/1990 | Hennigan | 52/144 |
| 5,013,597 | A | * | 5/1991 | Kracke | 428/141 |
| 5,044,705 | A | | 9/1991 | Nelson | |
| 5,374,468 | A | * | 12/1994 | Babinsky et al. | 428/172 |
| 5,652,415 | A | * | 7/1997 | Pelzer et al. | 181/286 |
| 5,916,681 | A | * | 6/1999 | Cipin | 428/403 |
| 5,965,851 | A | | 10/1999 | Herreman et al. | |
| 5,969,301 | A | * | 10/1999 | Cullum et al. | 181/286 |
| 6,035,965 | A | * | 3/2000 | Fujiwara et al. | 181/293 |
| 6,512,831 | B1 | * | 1/2003 | Herreman et al. | 381/71.3 |

(Continued)

FOREIGN PATENT DOCUMENTS

DE 23 47 252 3/1975

(Continued)

OTHER PUBLICATIONS

European Patent Office 0 381 586 Aug. 1990.*

(Continued)

*Primary Examiner* — Frankie L Stinson
(74) *Attorney, Agent, or Firm* — Alston & Bird LLP

(57) ABSTRACT

An acoustic panel for reducing the transmission of noise therethrough is provided. The acoustic panel may include a sound-absorbing surface with a plurality of convex and concave structures. The convex and concave structures may be organized in a regular array and may be spatially arranged to be alternating with one another. A dishwasher may use such an acoustic panel including a panel of sound absorbing material by placing such a panel inside the door, in or around the walls of the tub of a dishwasher, or the panel can also be used to reduce the transmission of noise with other products. A method of inserting a panel of sound-absorbing material into the door of a dishwasher is also provided. The panel may include protrusions extending from one of its surfaces in order to engage a supporting surface of the product to which it is attached.

22 Claims, 4 Drawing Sheets

U.S. PATENT DOCUMENTS

| | | | | |
|---|---|---|---|---|
| 6,539,955 | B1 | 4/2003 | Tilton et al. | |
| 6,939,599 | B2 * | 9/2005 | Clark | 428/178 |
| 7,011,181 | B2 * | 3/2006 | Albin, Jr. | 181/290 |
| 7,308,965 | B2 * | 12/2007 | Sapoval et al. | 181/210 |
| 7,409,959 | B2 | 8/2008 | Retsema | |
| 2003/0008581 | A1 * | 1/2003 | Tilton et al. | 442/181 |
| 2005/0079739 | A1 | 4/2005 | Illerhaus | |
| 2006/0169531 | A1 * | 8/2006 | Volker | 181/204 |
| 2006/0266385 | A1 * | 11/2006 | Malaker | 134/56 D |
| 2008/0128005 | A1 | 6/2008 | Haeberle et al. | |
| 2008/0223421 | A1 | 9/2008 | Rosenbauer et al. | |
| 2008/0236637 | A1 | 10/2008 | Pyo et al. | |
| 2008/0238274 | A1 | 10/2008 | Seo et al. | |
| 2010/0116405 | A1 * | 5/2010 | Kipp et al. | 156/39 |

FOREIGN PATENT DOCUMENTS

| | | | | |
|---|---|---|---|---|
| DE | 23 47 252 | A1 | | 3/1975 |
| DE | 44 43 919 | A1 | | 6/1996 |
| DE | 198 58 002 | | * | 6/2000 |
| DE | 101 18 632 | A1 | | 10/2002 |
| DE | 10 2005 061 805 | A1 | | 6/2007 |
| EP | 0 561 201 | | | 10/1997 |
| FR | 2 432 196 | | * | 3/1980 |
| GB | 1 424 422 | | * | 2/1976 |
| JP | 01-175541 | | * | 7/1989 |
| JP | 05-130965 | | * | 5/1993 |
| JP | 7-286482 | | | 10/1995 |
| JP | 2000-034820 | | * | 2/2000 |
| KR | 2001110899 | | * | 12/2000 |
| KR | 10-2005-0005874 | | | 1/2005 |
| WO | WO 2008/141380 | A1 | | 11/2008 |

OTHER PUBLICATIONS

Euorpean Patent Office 0 561 201 Sep. 1993.*
European Patent Office 1 342 857 Sep. 2002.*
International Search Report and Written Opinion for Application No. PCT/US2010/021128 mailed Aug. 16, 2010.

* cited by examiner

ACOUSTIC PANEL

BACKGROUND OF THE INVENTION

One issue of interest in the field of dishwashers is to reduce the externally perceptible noise generated by a dishwasher when the dishwasher is in use. However, because of the nature of the device, and the number of components cooperating to circulate the water in the operating unit, such noise reduction generally may be accomplished by analyzing and targeting particular components on an individual basis, such that the overall combined noise produced by the dishwasher is reduced.

Particular areas of interest include the door assembly and the walls surrounding the wash cavity of the dishwasher. The door assembly provides access to the wash cavity of the dishwasher where the dishware is loaded and washed. The water used to clean and rinse the dishware splashes against the tub defining the wash cavity and the door assembly, which transmit noise to the exterior of the dishwasher.

Other sources of noise that may be transmitted through the walls and door assembly include the pumps and fans in or proximate the wash cavity that may operate during the clean, rinse, and dry cycles of the dishwasher, and vibrations created from components of the dishwasher that transmit through the frame of the dishwasher to the walls and door assembly. Also, in some cases, the walls and door assembly may house or contain one or more electronic components that may add to the noise being transmitted to the exterior of the dishwasher.

A door assembly typically includes an inner panel adjacent to the tub of the dishwasher and an outer panel adjacent to the outside environment of the dishwasher. Also, in some embodiments, the door assembly may include an intermediate panel extending between the inner and outer panels.

The tub forms a wash cavity. The tub can comprise a multi-walled structure with internal space between the walls. Additionally, the walls surrounding the wash cavity may further comprise exterior panels which surround the tub and can provide additional internal space between the exterior panels and the tub.

BRIEF SUMMARY OF THE DISCLOSURE

Embodiments of the present disclosure seek to address the problem of noise transmission. In order to reduce noise transmission, an acoustic panel of sound-absorbing material may be provided. The acoustic panel may comprise a sound-absorbing surface having a plurality of convex structures and a plurality of concave structures, the convexity and concavity of which may be with respect to a first direction generally normal to the sound-absorbing surface of the panel of sound-absorbing material. The convex structures and the concave structures may be spatially arranged such that they alternate with one another along at least one direction in the panel. The panel may further comprise protrusions projecting in the first direction beyond the convex structures and the concave structures for engaging one or more supporting surfaces, such as a wall in a dishwasher door assembly, or a dishwasher tub wall. The convex structures and the concave structures may be separated from one another in a second direction generally lying in a plane of the sound-absorbing surface. Additionally, the convex structures may not all have the same dimensions, and the concave structures may not all have the same dimensions. Further, the sound-absorbing material may be rigid and, for example, may comprise expanded polystyrene.

In a further embodiment, a dishwasher comprises a tub for containing one or more pieces of dishware to be washed, a door, and a panel of sound-absorbing material, the panel of sound-absorbing material comprising a sound-absorbing surface. The sound-absorbing surface may comprise a plurality of convex structures and a plurality of concave structures, the convexity and concavity of which may be with respect to a first direction generally normal to the sound-absorbing surface of the panel of sound-absorbing material, and wherein the convex structures and the concave structures may be spatially arranged to be alternating with one another. The convex structures and concave structures may be arranged in a regular array. Additionally, the regular array may comprise a plurality of rows and a plurality of columns, wherein each of the rows has alternating convex structures and concave structures, and wherein each of the columns has alternating convex structures and concave structures. Further, the convex structures and concave structures in the array may alternate with one another along at least two different directions. The panel of sound-absorbing material may further comprise protrusions extending outwardly from the sound-absorbing surface in the first direction for engaging a supporting surface. The protrusions may be located between the convex structures and the concave structures. The panel of sound-absorbing material may further comprise a back surface for engaging another supporting surface. The supporting surfaces may comprise one or more internal portions of a wall of the dishwasher. Alternatively, the supporting surfaces may comprise one or more internal portions of an internal cavity of the door of the dishwasher. Additionally, the panel of sound-absorbing material may comprise a recessed well configured to receive a dispenser contained in the internal cavity of the door. The recessed well may comprise a bottom surface that comprises an additional plurality of convex structures and an additional plurality of concave structures alternating with one another. Further, the panel of sound-absorbing material may comprise a recessed channel configured to receive a drain duct contained in the internal cavity of the door. The recessed channel may comprise a bottom surface having alternating convex structures and concave structures.

An additional embodiment comprises a method of reducing sound emissions from a dishwasher, comprising: inserting a panel of sound-absorbing material into a dishwasher, and engaging a plurality of protrusions extending from a sound-absorbing surface of the panel of sound-absorbing material with one or more supporting surfaces, wherein the panel of sound-absorbing material comprises a plurality of convex structures and a plurality of concave structures, and wherein the convex structures and the concave structures are spatially arranged to be alternating with each other. The step of engaging the protrusions with one or more of the supporting surfaces may comprise inserting the panel of sound-absorbing material into an interior cavity of a dishwasher door.

BRIEF DESCRIPTION OF THE SEVERAL VIEWS OF THE DRAWING(S)

Having thus described the embodiments in general terms, reference will now be made to the accompanying drawings, which are not necessarily drawn to scale, and wherein:

DETAILED DESCRIPTION OF THE DRAWINGS

Embodiments of an acoustic panel now will be described more fully hereinafter with reference to the accompanying drawings in which some but not all embodiments are shown. Indeed, the acoustic panel may be embodied in many different forms and should not be construed as limited to the embodiments set forth herein; rather, these embodiments are provided so that this disclosure will satisfy applicable legal requirements. Like numbers refer to like elements throughout.

Figure 1:
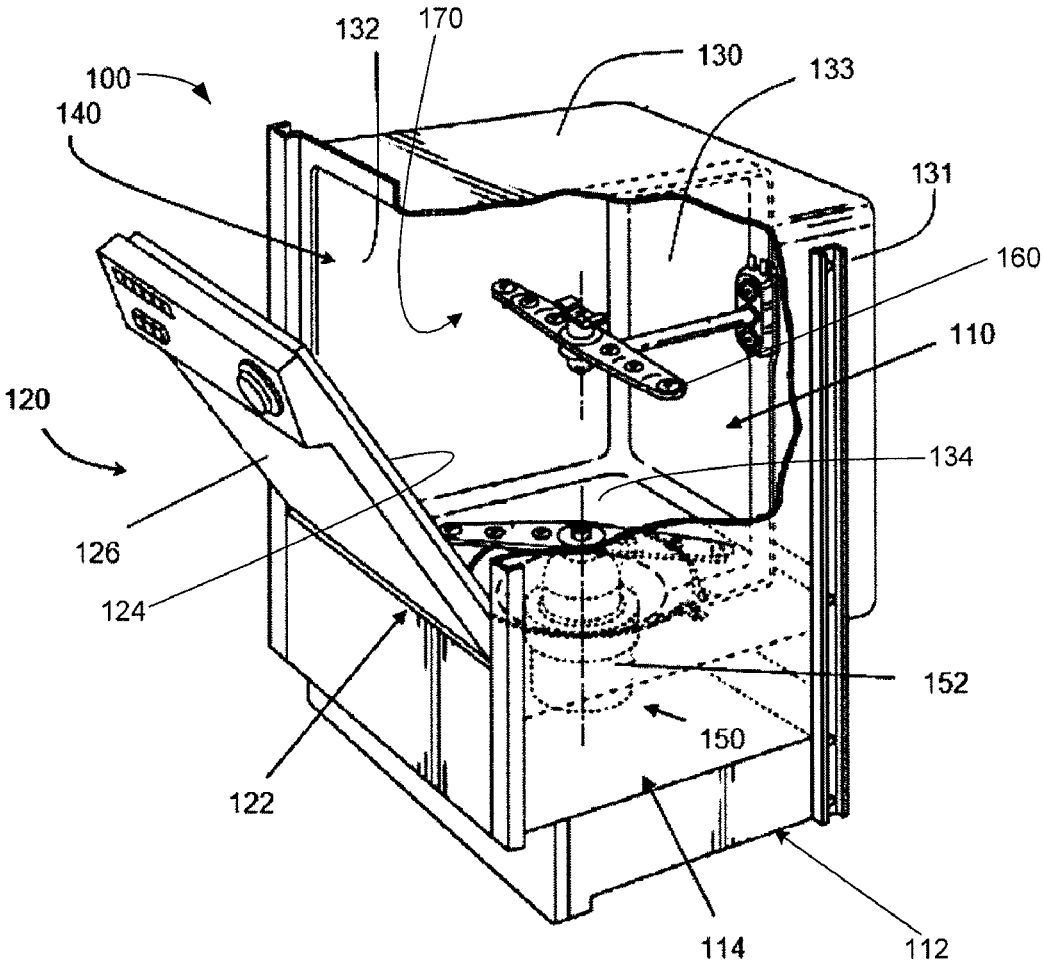
FIG. 1 is a perspective view of a dishwasher of a type suitable for use with various embodiments.

FIG. 1 illustrates an example of a dishwasher 100 that may benefit from various embodiments of the acoustic panel. The dishwasher 100 may include a tub 110 (partly broken away in FIG. 1 to show internal details) and a door assembly 120, formed by plurality of walls (e.g., a top wall 130, a left side wall 131, a right side wall 132, a rear wall 133, and a bottom wall 134), and that together form a wash cavity 170 in which dishes, utensils, and other dishware may be placed for washing. The tub 110 may also define a forward access opening 140. As known in the art, the dishwasher 100 may also include slidable lower and upper racks (not shown) for holding the dishes, utensils, and other dishware to be washed. The tub 110 may define a sump 150, in which wash water or rinse water is collected, typically under the influence of gravity. The wash/rinse water may be pumped by a pump 152 out of the sump 150 via a heater to various spray arms 160 mounted in the interior of the tub 110 for spraying the wash/rinse water, under pressure, onto the dishes, utensils, and other dishware contained therein. The pump 152 and/or other operational components (e.g., fans, motors, electrical outlets, valves, etc.) may be housed, disposed, or otherwise positioned within a base 112 positioned beneath the tub 110, wherein the base 112 receives and supports a lower end 114 of the tub 110.

The door assembly 120 may be pivotably engaged with the tub 110 about the lower end 114 thereof so as to selectively permit access to the interior of the tub. That is, a lower edge 122 of the door assembly 120 may be pivotably engaged (e.g., hinged) with the lower end 114 of the tub 110 such that the door assembly is pivotable about the lower edge thereof to cover and seal the forward access opening 140 in a closed position when the dishwasher 100 is in operation and to provide access to the wash cavity 170 through the forward access opening when the door assembly is pivoted from the closed position to an opened position. In some instances, the door assembly 120 may comprise an inner panel 124 and an outer panel 126 forming an inner cavity therebetween (not shown).

In operation, the dishwasher 100 may be activated to initiate the dishwashing process. After a predetermined amount of water is introduced, a cleaning cycle may begin. As detergent is introduced, a pump 152 at the bottom of the tub 110 pumps the water up to the spray arms 160 that spray the water over the dishware in the tub to clean the dishware. Eventually, the now dirty water can be drained from the tub 110 and more water may be introduced to start a rinse cycle. The wash and rinse cycles can be repeated if desired. After the rinse cycle is complete, the water within the tub 110 may be drained and the drying cycle may be initiated. As part of this, one or more fan assemblies (not shown) can be activated to evacuate warm moist air from the tub 110 and introduce drier air from the outside of the dishwasher 100 to reduce the time necessary to dry the dishware located within the tub.

Components such as the pump 152, spray arms 160, and fan assemblies (not shown) create noise. Additionally, the water used to clean and rinse the dishware splashes against the tub 110 defining the wash cavity 170 and the inner panel 124 of the door assembly 120. The operation of the components and the splashing of water may result in the undesirable transmission of noise to the exterior of the dishwasher 100.

Figure 2:
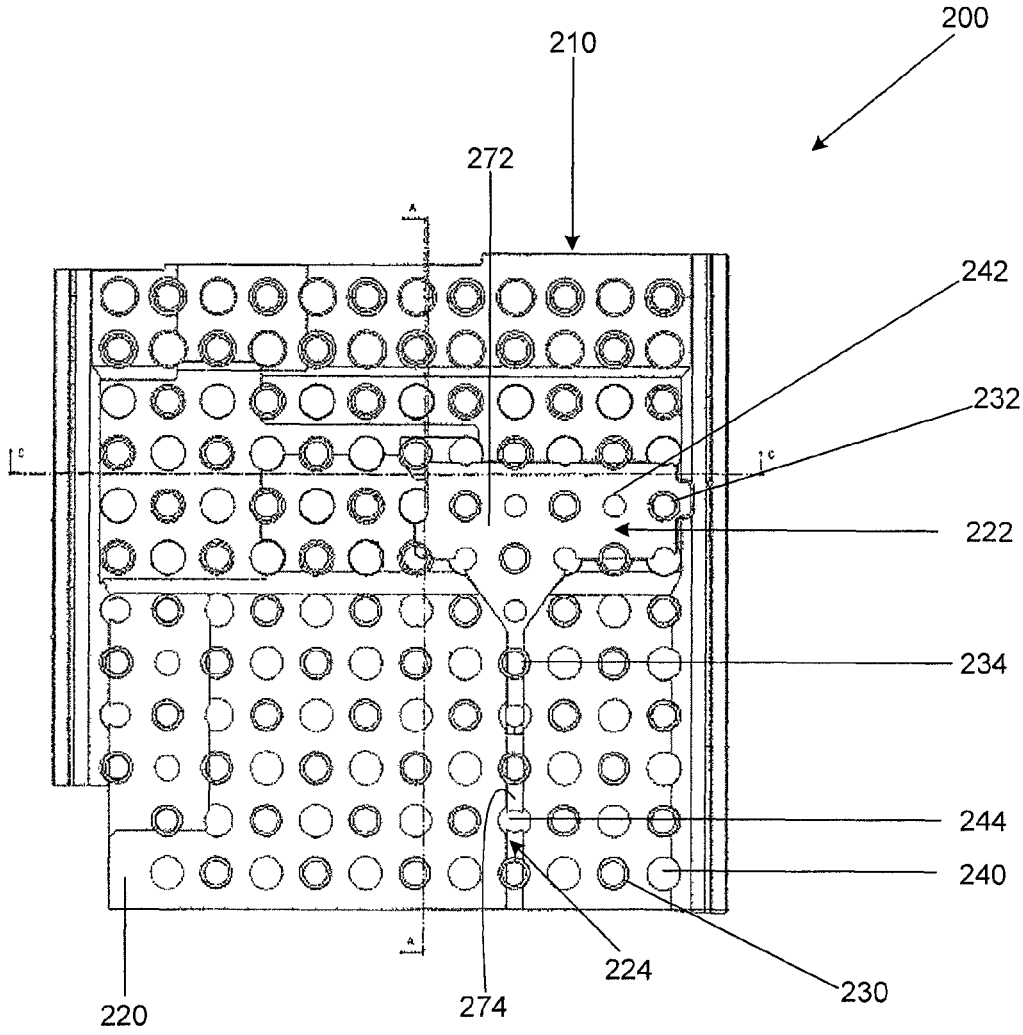
FIG. 2 is a plan view of an acoustic panel configured for a dishwasher door assembly.

Accordingly, embodiments herein described are directed to attenuating acoustic emissions transmitted to the surrounding environment through the walls 130-134 and door assembly 120 of a dishwasher 100. With respect to the door assembly 120 of a dishwasher 100, it may include an acoustic panel which may be placed inside the door assembly 120. An example of an acoustic panel 200 is shown in FIG. 2. The acoustic panel 200 may be formed of a panel of sound-absorbing material 210 and may comprise a multipiece structure or can be unitary. With regard to the material comprising the panel 210, many known materials may be used, including but not limited to foam and expanded foam materials. Materials such as expanded polystyrene have the advantage that they form a rigid structure, and hence engagement with a supporting surface can be facilitated, as will be described below.

The panel of sound-absorbing material 210 includes a major surface that comprises a sound-absorbing surface 220 having a plurality of convex structures 240 and concave structures 230. "Sound-absorbing" is herein meant to generally refer to the ability of the material and structure to reduce sound transmission as opposed to a description of a method by which such reduction occurs. Further, the term "panel" is not meant to be limited to a substantially flat section of material, but is also intended to be inclusive of other overall shapes.

With regard to the convex 240 and concave 230 structures, they may be positioned such that they alternate between concave and convex structures along the sound-absorbing surface 220 in a direction generally defined by the plane of the sound-absorbing surface. Also, the convex 240 and concave 230 structures may alternate with one another along at least two different directions. For example, as shown in FIG. 2, for a given convex structure 240, the structure to the right of the convex structure and the structure below the convex structure may both be concave structures 230. Further, the convex 240 and concave 230 structures may be arranged in a regular array. In particular, the array may comprise rows and columns of convex 240 and concave 230 structures wherein each row and each column may be comprised of alternating convex and concave structures.

The concave 230 and convex 240 structures may be sized such that each structure has the same magnitude of size (e.g. height and depth, respectively). Alternately, some of the convex structures 240 and the concave structures 230 may be sized differently. This could involve the use of convex structures 240 having a different size as compared to the concave structures 230. Alternatively or additionally some convex structures 240 and concave structures 230 could have the same size, while other convex and concave structures could have a different size. The use of differing sized structures 230, 240 may assist in reducing the transmission of noises covering multiple frequency ranges.

Figure 3:
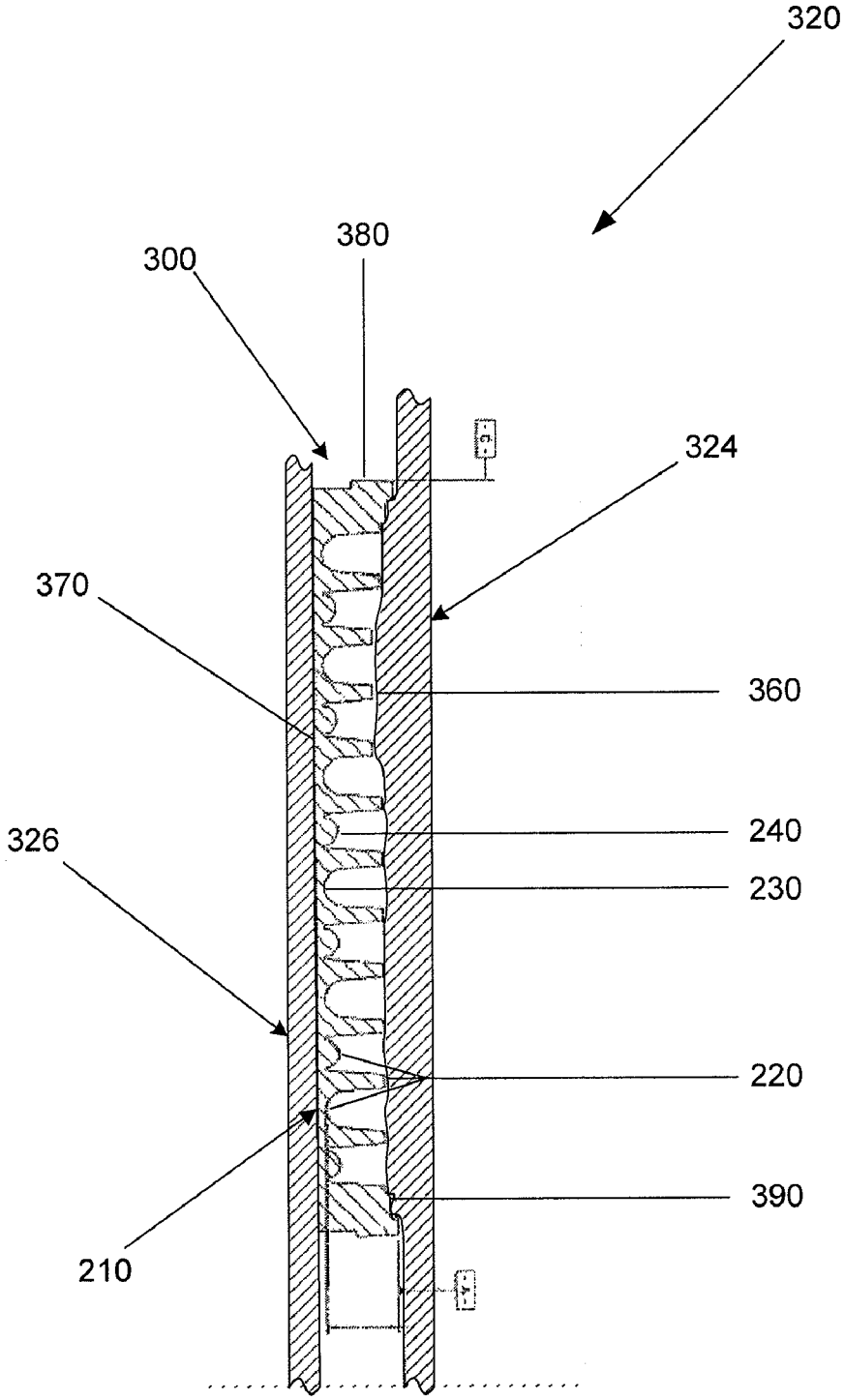
FIG. 3 is a sectional view of a dishwasher door assembly with an acoustic panel having protrusions.

With regard to the attachment of the panel of sound-absorbing material 210 to a sound emitting or transmitting structure, the sound-absorbing surface 220 may engage one or more supporting surfaces of the item to which it attaches. In order to attach to the supporting surface, the panel of sound absorbing material 210 may comprise a plurality of protrusions. As shown on the acoustic panel 300 in FIG. 3, these protrusions 360 can extend from any surface of the panel of sound-absorbing material 210, including the sound-absorbing surface 220. When the protrusions 360 extend from the sound-absorbing surface 220, they may extend from the areas between the convex 240 and concave 230 structures. Alternatively, the protrusions 360 may extend from a back surface 370 or a side surface 380. The protrusions 360 can be sized and shaped so as to engage particular features of a supporting surface. For instance, the protrusions 360 extending from edge portions 390 of the sound-absorbing surface 220 may be shaped differently than the protrusions extending from the rest of the sound-absorbing surface. The protrusions 360 may have the additional function of creating an air gap between the panel of sound-absorbing material 210 and a supporting surface, which provides insulating advantages. Regardless of whether the panel of sound-absorbing material 210 includes protrusions 360, it may be supported on multiple sides. For example, the sound-absorbing surface 220 may engage one supporting surface such as an internal panel 324 of a dishwasher door assembly 320, while the back surface 370 may engage another supporting surface such as an exterior panel 326 of the door assembly.

Figure 4:
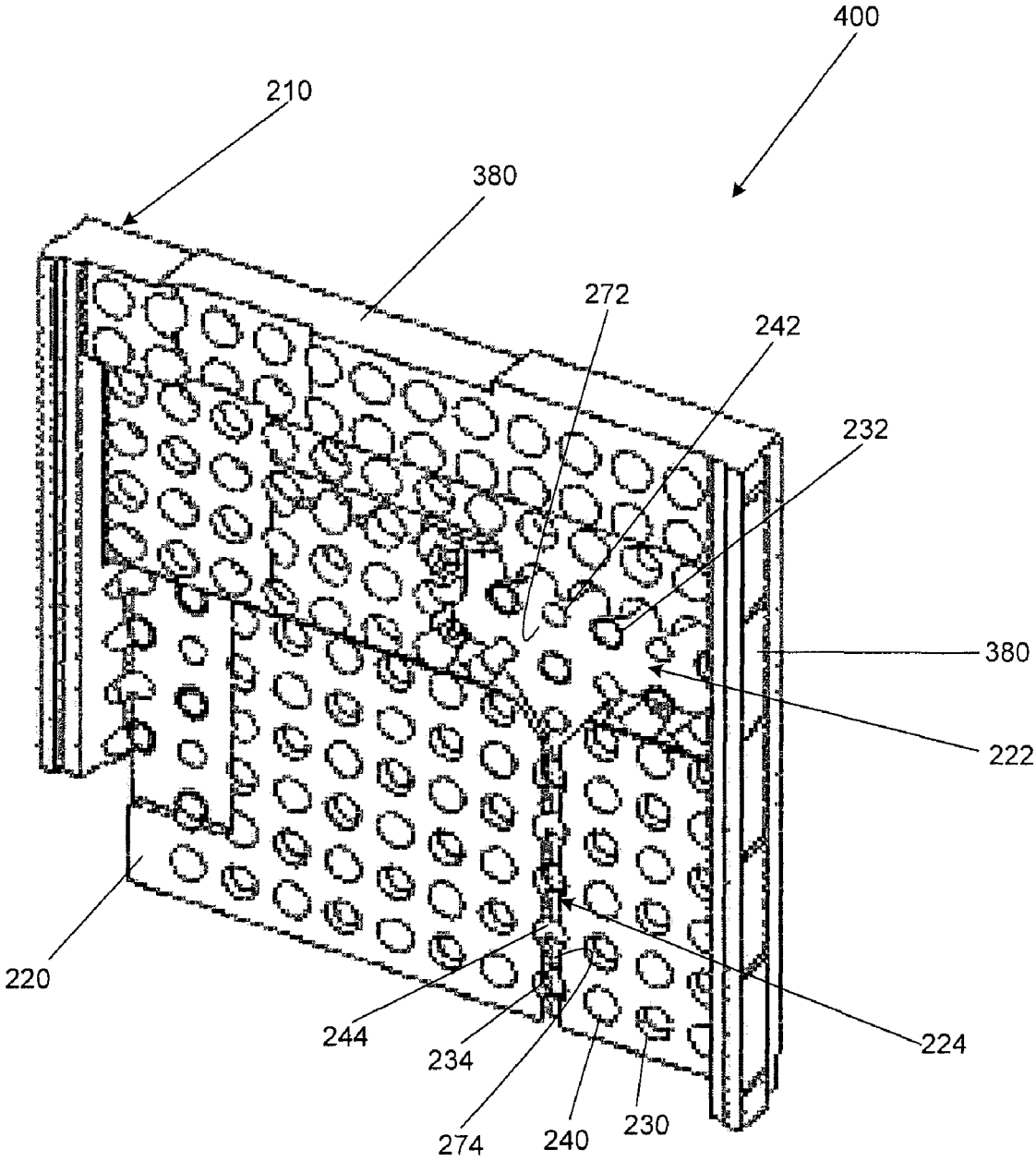
FIG. 4 is a perspective view of the acoustic panel of FIG. 2.

The acoustic panel 200, 300, 400 may also include additional features beyond protrusions 360 which customize the panel to the particular environment in which it is installed. For instance, in a dishwasher door assembly 120, the door assembly may include a soap dispenser and/or rinse aid dispenser. Accordingly, as shown in FIGS. 2 and 4, the acoustic panel 200, 400 may comprise a recessed well area 222 which corresponds to the location of the dispenser. The recessed well area 222 may include a bottom surface 272 with additional pluralities of convex 242 and concave 232 structures. The dishwasher door assembly 120 may further include a drain duct extending downwardly through the door assembly. Accordingly the acoustic panel 200, 400 may further comprise a recessed channel 224 which corresponds to the drain duct. The recessed channel 224 may also include a bottom surface 274 with additional pluralities of convex 244 and concave 234 structures. These additional convex 242, 244 and concave 232, 234 structures can be positioned such that they alternate with one another as described above with respect to the non-recessed portions of the acoustic panel 200, 400. The additional alternating convex 242, 244 and concave 232, 234 structures may reduce the transmission of noise along the drain duct, which is believed to act as a sound emission conduit.

For the sake of brevity, the acoustic panel 200, 300, 400 has primarily been discussed in terms of being positioned within a door assembly 120 of a dishwasher 100. However, the acoustic panel 200, 300, 400 could also be mounted in or on a wall 130-134 surrounding the wash cavity 170. In this regard, the tub 110 may comprise a multi-panel structure in which each wall 130-134 comprises multiple panels. In such a case, the acoustic panel 200, 300, 400 can be inserted between the individual panels of a tub wall 130-134 or otherwise attached to one or more of the panels forming the walls. Additionally or alternatively, one or more acoustic panels 200, 300, 400 may be attached to the exterior of the tub walls 130-134 such that the exterior of the tub 110 comprises a supporting surface. Further, while the acoustic panel 200, 300, 400 has been described as a separate structure from the structures to which it attaches, it is possible to integrate the two. For instance, an outer panel 126 defining the door assembly 120 of a dishwasher 100 could also act as the back surface of an acoustic panel 200, 300, 400 in that the panel could include the alternating pattern of convex 240 and concave 230 structures extending from an internal surface of the outer panel.

Further, the embodiments have been described primarily with respect to use of an acoustic panel 200, 300, 400 in conjunction with a dishwasher 100. However, the acoustic panel 200, 300, 400 may also be used to reduce sound emissions or transmissions from a variety of different products. For example, the acoustic panel 200, 300, 400 could be used to reduce noise emitting from a washing machine or from products outside of the appliance context such as engine bays.

It is believed that the embodiments of the acoustic panel 200, 300, 400 help to manage the transmission of sound. For example and while not intending to be bound by any particular theory, the alternating pattern of convex 240 and concave 230 structures are believed to cancel sound waves. Regardless of the particular theory by which the acoustic panel 200, 300, 400 functions, the panel of sound-absorbing material 210 with alternating concave 230 and convex 240 structures is believed to reduce sound transmission more effectively than a flat panel of sound-absorbing material.

In some embodiments, an acoustic panel 200, 300, 400 as herein described may be used to retrofit or modify existing dishwashers 100 and other products. For example, an acoustic panel 200, 300, 400 may be inserted into a door assembly 120 of an existing dishwasher 100, or an acoustic panel may be attached to the outside of a tub wall 130-134 surrounding the wash cavity 170.

Many modifications and other embodiments of the acoustic panel set forth herein will come to mind to one skilled in the art having the benefit of the teachings presented in the foregoing descriptions and the associated drawings. Therefore, it is to be understood that the acoustic panel is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A dishwasher, comprising:

a tub for containing dishware to be washed, the tub comprising a plurality of walls that together form a wash cavity;

a door operably engaged with the tub;

a panel of sound-absorbing material positioned within the door or within, or exterior to, at least one of the plurality of walls for reducing sound emissions from the dishwasher, the panel of sound-absorbing material having a major surface comprising a sound-absorbing surface;

wherein the sound-absorbing surface comprises a plurality of convex structures and a plurality of concave structures, the convexity and concavity of which are with respect to a first direction generally normal to the sound-absorbing surface, and wherein the convex structures and the concave structures are spatially arranged to be alternating with one another, wherein the panel further comprises a plurality of protrusions extending outwardly from the sound-absorbing surface from areas between the convex structures and the concave structures.

2. The dishwasher of claim 1, wherein the convex structures and concave structures are arranged in a regular array.

3. The dishwasher of claim 2, wherein the regular array comprises a plurality of rows and a plurality of columns, wherein each of the rows has alternating convex structures and concave structures, and wherein each of the columns has alternating convex structures and concave structures.

4. The dishwasher of claim 1, wherein the convex structures and concave structures are alternating with one another along at least two different directions in the panel.

5. The dishwasher of claim 1, wherein the protrusions extend outwardly from the sound-absorbing surface in the first direction, wherein the protrusions engage one or more supporting surfaces of the dishwasher.

6. The dishwasher of claim 5, wherein the panel of sound-absorbing material further comprises a back surface, and wherein the back surface engages one or more supporting surfaces of the dishwasher.

7. The dishwasher of claim 5, wherein the supporting surfaces comprise one or more internal portions of a wall of the dishwasher.

8. The dishwasher of claim 5, wherein the supporting surfaces comprise one or more internal portions of an internal cavity of the door of the dishwasher.

9. The dishwasher of claim 8, wherein the panel of sound-absorbing material comprises a recessed well configured to receive a dispenser contained in the internal cavity of the door.

10. The dishwasher of claim 9, wherein the recessed well comprises a bottom surface, wherein the bottom surface comprises an additional plurality of convex structures and an additional plurality of concave structures, and wherein the convex structures and the concave structures are spatially arranged to be alternating with one another.

11. The dishwasher of claim 8, wherein the panel of sound-absorbing material comprises a recessed channel configured to receive a drain duct contained in the internal cavity of the door.

12. The dishwasher of claim 11, wherein the recessed channel comprises a bottom surface, wherein the bottom surface comprises an additional plurality of convex structures and an additional plurality of concave structures, and wherein the convex structures and the concave structures are spatially arranged to be alternating with one another.

13. The dishwasher of claim 1, wherein the protrusions are configured to create an air gap between the panel of sound-absorbing material and one or more supporting surfaces.

14. A method of reducing sound emissions from a dishwasher, comprising:

inserting a panel of sound-absorbing material into a dishwasher, and engaging a plurality of protrusions extending outwardly from a sound-absorbing surface of the panel of sound-absorbing material with one or more supporting surfaces, wherein the sound-absorbing surface comprises a plurality of convex structures and a plurality of concave structures, and wherein the convex structures and the concave structures are spatially arranged to be alternating with one another, and wherein the protrusions extend from the sound-absorbing surface from areas between the convex structures and the concave structures.

15. The method of reducing sound emissions from a dishwasher of claim 14, wherein the step of engaging the protrusions with one or more of the supporting surfaces comprises inserting the panel of sound-absorbing material into an interior cavity of a dishwasher door.

16. The method of claim 14, wherein the protrusions are configured to create an air gap between the panel of sound-absorbing material and the one or more supporting surfaces.

17. An acoustic panel, comprising:

a panel of sound-absorbing material having a major surface comprising a sound-absorbing surface, wherein the sound-absorbing surface comprises a plurality of convex structures and a plurality of concave structures, the convexity and concavity of which are with respect to a first direction generally normal to the sound-absorbing surface, wherein the convex structures and the concave structures are spatially arranged to be alternating with one another, and wherein the panel further comprises protrusions extending outwardly from the sound absorbing surface in the first direction beyond the convex structures and the concave structures for engaging one or more supporting surfaces, and wherein the protrusions extend from the sound-absorbing surface from areas between the convex structures and the concave structures.

18. The acoustic panel of claim 17, wherein the convex structures and the concave structures are separated from one another in a second direction generally lying in a plane of the sound-absorbing surface.

19. The acoustic panel of claim 17, wherein the convex structures do not all have the same dimensions, and wherein the concave structures do not all have the same dimensions.

20. The acoustic panel of claim 17, wherein the sound-absorbing material is rigid.

21. The acoustic panel of claim 20, wherein the sound-absorbing material comprises expanded polystyrene.

22. The acoustic panel of claim 17, wherein the protrusions are configured to create an air gap between the panel of sound-absorbing material and the one or more supporting surfaces.

* * * * *